US008720756B2

(12) United States Patent
Parsons

(10) Patent No.: US 8,720,756 B2
(45) Date of Patent: May 13, 2014

(54) CLIP WITH C-SHAPED LIGATURE

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 284 days.

(21) Appl. No.: 13/317,870

(22) Filed: Oct. 31, 2011

(65) Prior Publication Data

US 2013/0105531 A1 May 2, 2013

(51) Int. Cl.

| | |
|---|---|
| ***A45F 5/00*** | (2006.01) |
| *A45F 3/00* | (2006.01) |
| *A47G 23/02* | (2006.01) |

(52) U.S. Cl.

CPC ..... *A45F 5/00* (2013.01); *A45F 2003/002* (2013.01); *A47G 23/0225* (2013.01)

USPC ..... 224/269; 248/690; 248/691; 248/692

(58) Field of Classification Search

CPC A45F 5/00; A45F 2003/002; A47F 2003/002

USPC ..... 224/269; 248/690–692; 24/3.12; 220/482

See application file for complete search history.

(56) References Cited

U.S. PATENT DOCUMENTS

| | | | | |
|---|---|---|---|---|
| 969,524 | A | 9/1910 | Condon | |
| 1,051,651 | A * | 1/1913 | Tunnessen | 220/817 |
| 2,248,513 | A * | 7/1941 | Riley | 211/75 |
| D271,820 | S | 12/1983 | Allen | |
| 4,767,092 | A * | 8/1988 | Weatherly | 248/311.2 |
| 4,955,518 | A * | 9/1990 | Parsons et al. | 224/247 |
| 4,955,572 | A * | 9/1990 | Simmons | 248/312 |
| 4,993,611 | A * | 2/1991 | Longo | 224/148.4 |
| 5,188,362 | A | 2/1993 | Ashihara | |
| 5,232,137 | A | 8/1993 | Devine | |
| 5,390,838 | A * | 2/1995 | Jafarkhani | 224/148.4 |
| 5,440,465 | A | 8/1995 | Hasness | |
| 5,489,075 | A * | 2/1996 | Ible | 248/104 |
| 5,628,486 | A * | 5/1997 | Rossman et al. | 248/311.2 |
| 5,671,877 | A * | 9/1997 | Yabuya | 224/282 |
| 5,919,093 | A * | 7/1999 | Parsons | 463/47.7 |
| D412,590 | S * | 8/1999 | Parsons | D26/49 |
| 5,947,352 | A * | 9/1999 | Parsons | 224/250 |
| 5,954,247 | A * | 9/1999 | Savine et al. | 224/148.4 |
| D423,774 | S | 5/2000 | Peterson | |
| 6,131,779 | A | 10/2000 | Gendala | |
| 6,279,794 | B1 | 8/2001 | Miyazaki | |
| 6,349,844 | B1 * | 2/2002 | Betras | 220/709 |
| 6,581,886 | B1 * | 6/2003 | Suh | 248/104 |
| 6,663,068 | B2 * | 12/2003 | Huang | 248/311.2 |
| 6,837,472 | B1 * | 1/2005 | Beutz | 248/312 |
| D528,786 | S | 9/2006 | Parsons | |
| 7,744,053 | B2 * | 6/2010 | Perman | 248/312 |
| 7,748,583 | B1 * | 7/2010 | Woltman | 224/251 |
| 2003/0087702 | A1 * | 5/2003 | Parsons | 463/47.2 |

* cited by examiner

*Primary Examiner* — Brian D Nash

(74) *Attorney, Agent, or Firm* — Husch Blackwell LLP

(57) ABSTRACT

A clip for releasable engagement with a user-operated device and for releasable attachment to a user's person, and devices that comprise such clips.

18 Claims, 1 Drawing Sheet

CLIP WITH C-SHAPED LIGATURE

This invention pertains to a clip for releasable engagement with a user-operated device and for releasable attachment to a user's person, and to such devices that also comprise such clips.

BRIEF DESCRIPTION OF THE DRAWINGS

The following drawings illustrate the concepts of the present invention, and are not necessarily drawn to scale.

DETAILED DESCRIPTION OF SOME EMBODIMENTS

Figure 1:
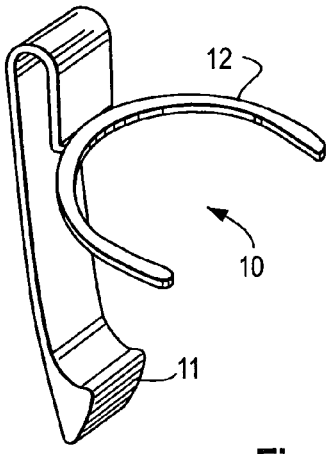
FIG. 1 is a perspective view of an embodiment of a clip.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

Some user-operated devices, such as expandable batons, flashlights, chemical spray dispensers, multi-function devices (such as a combined baton and flashlight), etc., often are carried by attaching them to one's person. This is typical for law enforcement officers and civilian and military security personnel.

It is advantageous to have a clip for such attachment that also can engage the device releasably, and can engage the device at different locations on the device and with different orientations with respect to the remainder of the device. One advantage of the releasable engagement is that a damaged clip can be replaced easily. An advantage of being able to change readily the location or orientation of the clip's engagement with the device is that the user can modify the amount and part of the device that is visible depending on the user's needs and depending on where the device is attached to the user's person. This can be important to security personnel. Furthermore, different locations and orientations of the clip's engagement with the device may render the device more accessible and more comfortable, depending on where on the user's person that the device is attached.

Figure 2:
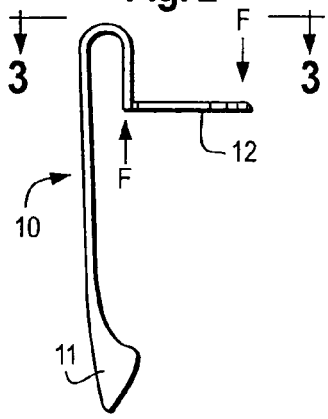
FIG. 2 is a side view of the clip of FIG. 1.
Figure 3:
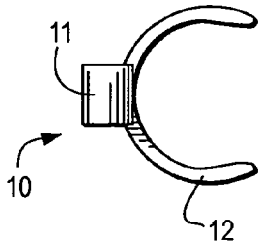
FIG. 3 is a top view of the clip taken along 3-3 of FIG. 2.

FIGS. 1-3 illustrate one embodiment of such a clip 10 with an attaching portion 11 integrally joined with a generally C-shaped supporting portion 12. In this embodiment, the attaching portion 11 comprises a hook, and can be structured and dimensioned for releasably attaching clip 10 to a belt, a waistband, a pocket, or another edge of clothing, etc.

Figure 4:
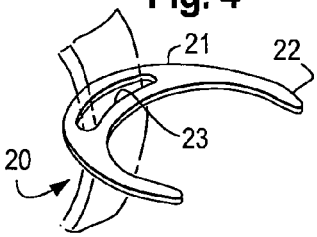
FIG. 4 is perspective view of another embodiment of a clip.
Figure 5:
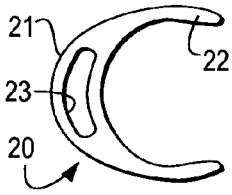
FIG. 5 is a top view of the clip of FIG. 4.

FIGS. 4 and 5 illustrate another embodiment of such a clip 20 with an attaching portion 21 and a generally C-shaped supporting portion 22. In this embodiment, the attaching portion 21 defines an opening 23, and can be structured and dimensioned for releasably attaching clip 20 to a lanyard, a releasable loop, or a releasable ring, etc.

A clip 10 or 20 can be fabricated as is known in the art, such as being formed of heat-treated metal.

Figure 6:
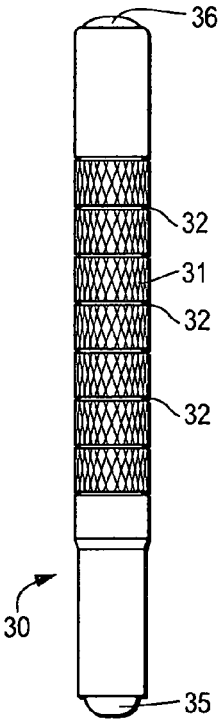
FIG. 6 is a side view of an expandable baton in the retracted state.
Figure 7:
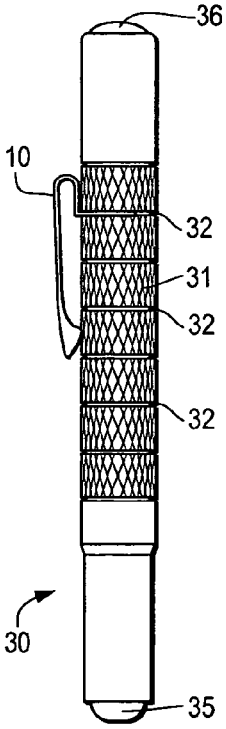
FIG. 7 is a side view of the clip of FIG. 1 engaged with the baton of FIG. 6.
Figure 8:
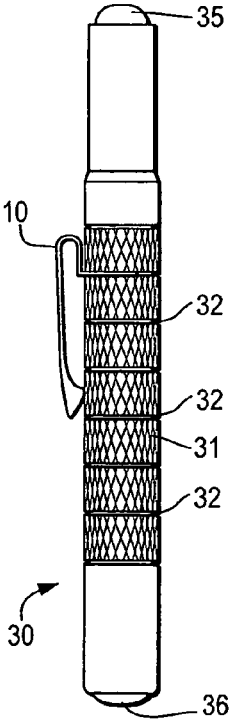
FIG. 8 is a side view of the clip of FIG. 1 engaged with the baton of FIG. 6, in a different groove and with a different orientation than is shown in FIG. 7.
Figure 9:
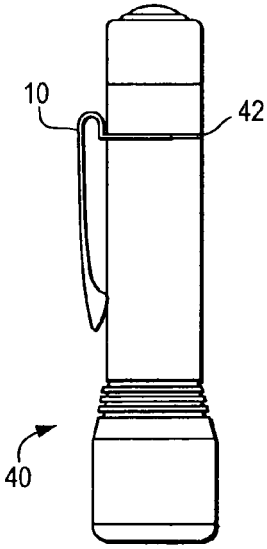
FIG. 9 is a side view of the clip of FIG. 1 engaged with a flashlight.

FIG. 6 shows an example of an expandable baton 30 (in the retracted state). In FIGS. 7 and 8, baton 30 is shown engaged with a clip 10. FIG. 9 is an example of a flashlight 40 that is shown engaged with a clip 10.

In the example of FIGS. 6-8, baton 30 comprises a tip end 35 (that can expand out longitudinally), a cap end 36, and a gripping surface 31 that comprises cross-hatched channels that enhance one's ability to grip the surface firmly. This "flat knurling" is more comfortable to hold than a surface with "lumpier" knurls, and is more durable and easier to manufacture than a device with a foam gripping surface.

In some embodiments, devices (such as baton 30 or flashlight 40) to be engaged with clips (such as clip 10 or clip 20) include at least one groove (such as grooves 32 or 42) that may be in a cylindrical surface of the device. Preferably, there are multiple grooves 32 as seen in FIGS. 6-8, so that clip 10 can be engaged at different locations on baton 30. In FIG. 7, for example, clip 10 is engaged in a different groove 32 and with a different orientation with respect to baton 30 than is shown in FIG. 8. In some examples, there can be a plurality of annular grooves 32, as seen in FIGS. 6-8. In other examples, a clip (such as clip 10 or clip 20) can engage a spiral groove (not shown) at any location along the spiral groove. In the example of FIGS. 6-8, the grooves 32 are deeper than the cross-hatched channels in the gripping surface 31.

The embodiments comprising clip 10 or clip 20 comprise a supporting portion 12 or a supporting portion 22. As seen best in FIGS. 3 and 5, the supporting portion (12 or 22) corresponds generally with an arc that extends more than 180°. As best seen in FIG. 2, supporting portion 12 is generally flat and planar, with a width measured in a plane of the arc that exceeds a thickness measured perpendicular to that plane. The supporting portions 12 and 22 each constitutes generally arcuate supporting means for supporting a device.

The supporting portion (12 or 22) releasably engages (or disengages from) a groove (32 or 42) by moving the clip (10 or 20) in a direction parallel to the plane of the arc and perpendicular to a longitudinal axis of the device (such as baton 30 or flashlight 40). The supporting portion (12 or 22) is sufficiently flexible so that its ends will move apart temporarily when the clip (10 or 20) is being pushed into or pulled out of a groove (32 or 42), and is sufficiently resilient to resume its original shape when its ends are no longer being forced apart.

A device (such as baton 30 or flashlight 40) can be supported by the supporting portion (12 or 22) because of forces acting in directions generally parallel with the longitudinal axis of the device (perpendicular to the plane of the arc that corresponds generally with the supporting portion (12 or 22)). For example, if clip 10 is engaged in groove 32 of baton 30 and the baton 30 is being supported by the clip 10, a top side of groove 32 would exert a downward force on the ends of the supporting portion 12 and a bottom side of groove 32 would exert an upward force on a part of supporting portion 12 that is joined with attaching portion 11. These forces are illustrated by the arrows F in FIG. 2. In this example, the generally flat and planar supporting portion 12 or 22 is acting as a cantilever to support the weight of the device (such as baton 30 or flashlight 40). The supporting portions 12 and 22 each constitutes supporting means for releasably engaging and disengaging with a groove (such as groove 32 or 42) in a surface surrounding a longitudinal axis of a device (such as baton 30 or flashlight 40), and for supporting the remainder of the device (i.e., other than the clip).

From the foregoing, it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A clip, for releasable engagement with a user-operated device, and for releasable attachment to a user's person, the clip comprising:

an attaching portion; and a generally C-shaped supporting portion;

the supporting portion comprising an outer circumferential edge and first and second ends;

the supporting portion being integrally joined with the attaching portion;

the edge extending, from a part of the supporting portion that is integrally joined with the attaching portion, in opposite directions to the first and second ends, respectively;

the supporting portion corresponding generally with an arc that extends more than 180° between the first and second ends;

the arc defining a plane;

at any particular point along the edge, the supporting portion having a thickness that is measured in a direction that is perpendicular to the plane, and the supporting portion having a width that is measured in a direction that is within the plane and that is perpendicular to the arc at a point of the arc that is closest to the particular point along the edge;

the width of the supporting portion exceeding the thickness of the supporting portion at substantially every point along the edge;

the supporting portion being sufficiently flexible so that the first and second ends can be temporarily forced away from each other, and the supporting portion being sufficiently resilient so that it will resume its original shape when the first and second ends are no longer being forced away from each other;

wherein, when the attaching portion is attached to the user's person and the supporting portion is engaged with an appropriately dimensioned groove of the user-operated device, the supporting portion acts as a cantilever, supporting the weight of the user-operated device through forces acting on the supporting portion in directions generally perpendicular to the plane.

2. The clip as in claim 1, the attaching portion comprising a hook.

3. The clip as in claim 1, the attaching portion being structured and dimensioned for releasably attaching to at least one of a group consisting of: a belt, a waistband, a pocket, and an edge of clothing.

4. The clip as in claim 1, the attaching portion defining an opening.

5. The clip as in claim 1, the attaching portion being structured and dimensioned for releasably attaching to at least one of a group consisting of: a lanyard, a releasable loop, and a releasable ring.

6. The clip as in claim 1, the clip being formed of heat-treated metal.

7. The clip as in claim 1, the supporting portion being generally flat and planar.

8. A combination comprising a clip, for releasable attachment to a user's person, and a user-operated device, the user-operated device comprising at least one groove that is appropriately dimensioned for releasable engagement with a generally C-shaped supporting portion of the clip;

the clip comprising:

an attaching portion; and the generally C-shaped supporting portion;

the supporting portion comprising an outer circumferential edge and first and second ends;

the supporting portion being integrally joined with the attaching portion;

the edge extending, from a part of the supporting portion that is integrally joined with the attaching portion, in opposite directions to the first and second ends, respectively;

the supporting portion corresponding generally with an arc that extends more than 180° between the first and second ends;

the arc defining a plane;

at any particular point along the edge, the supporting portion having a thickness that is measured in a direction that is perpendicular to the plane, and the supporting portion having a width that is measured in a direction that is within the plane and that is perpendicular to the arc at a point of the arc that is closest to the particular point along the edge;

the width of the supporting portion exceeding the thickness of the supporting portion at substantially every point along the edge;

the supporting portion being sufficiently flexible so that the first and second ends can be temporarily forced away from each other, and the supporting portion being sufficiently resilient so that it will resume its original shape when the first and second ends are no longer being forced away from each other;

wherein, when the attaching portion is attached to the user's person and the supporting portion is engaged with one of the at least one grooves of the user-operated device, the supporting portion acts as a cantilever, supporting the weight of the user-operated device through forces acting on the supporting portion in directions generally perpendicular to the plane.

9. The combination as in claim 8, the at least one groove being located in a generally cylindrical surface of the device.

10. The combination as in claim 8, the clip and the at least one groove being structured and dimensioned so that the supporting portion of the clip can be releasably engaged with the at least one groove in each one of a plurality of orientations of the clip with respect to the device.

11. The combination as in claim 8, the at least one groove comprising a plurality of grooves; and each one of the plurality of grooves being appropriately dimensioned for releasable engagement with the supporting portion of the clip.

12. The combination as in claim 8, the at least one groove being located in a surface surrounding a longitudinal axis of the device;

the device being constructed and dimensioned so that the supporting portion of the clip can be releasably engaged and disengaged with the at least one groove, by moving the clip relative to one of the at least one grooves in a direction that is generally perpendicular to the longitudinal axis.

13. The combination as in claim 8, the device being at least one of a group consisting of: a baton, a flashlight, and a chemical spray dispenser.

14. The combination as in claim 8, the device further comprising:

a gripping surface; and the gripping surface comprising cross-hatched channels.

15. The combination as in claim 14, the gripping surface comprising the at least one groove; and the at least one groove being deeper than the cross-hatched channels.

16. The combination as in claim 8, the at least one groove comprising a plurality of parallel annular grooves.

17. The combination as in claim 8, the at least one groove comprising a spiral groove.

18. A combination comprising a user-operated device and a clip that can be releasably attached to a user's person, the device comprising: at least one groove in a surface surrounding a longitudinal axis of the device; and the clip comprising:

an attaching portion; and a supporting means for releasably engaging and disengaging with the at least one groove by moving the clip in a direction that is generally perpendicular to the longitudinal axis; for releasably engaging with the at least one groove in each one of a plurality of orientations of the clip with respect to a remainder of the device; and for supporting the device because of forces acting on the supporting means in directions generally parallel with the longitudinal axis, if the supporting means is engaged with the at least one groove.

* * * * *